US009505243B2

(12) United States Patent
Sato

(10) Patent No.: US 9,505,243 B2
(45) Date of Patent: Nov. 29, 2016

(54) PRINT MEDIUM DEFORMATION DETECTING METHOD

(71) Applicant: SCREEN HOLDINGS CO., LTD., Kyoto (JP)

(72) Inventor: Toshihiro Sato, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 15/006,904

(22) Filed: Jan. 26, 2016

(65) Prior Publication Data

US 2016/0214413 A1 Jul. 28, 2016

(30) Foreign Application Priority Data

Jan. 26, 2015 (JP) ..... 2015-012461

(51) Int. Cl.

| | |
|---|---|
| ***B41J 11/00*** | (2006.01) |
| ***B41J 29/393*** | (2006.01) |
| ***B41J 2/36*** | (2006.01) |
| ***B41J 2/505*** | (2006.01) |

(52) U.S. Cl.

CPC ..... *B41J 11/0095* (2013.01); *B41J 11/008* (2013.01)

(58) Field of Classification Search

CPC ..... B41J 11/0095; B41J 29/393; B41J 2/36; B41J 2/362; B41J 2/5056

See application file for complete search history.

(56) References Cited

U.S. PATENT DOCUMENTS

| | | | | |
|---|---|---|---|---|
| 8,118,389 | B2 * | 2/2012 | Sasayama | B41J 2/2139 347/14 |
| 2013/0128286 | A1 * | 5/2013 | Tamagawa | G06K 15/02 358/1.2 |
| 2015/0283833 | A1 | 10/2015 | Fukui et al. | |

FOREIGN PATENT DOCUMENTS

| | | |
|---|---|---|
| JP | 2001-41726 A | 2/2001 |
| JP | 2014-27527 A | 2/2014 |

* cited by examiner

*Primary Examiner* — Jason Uhlenhake

(74) *Attorney, Agent, or Firm* — McDermott Will & Emery LLP

(57) ABSTRACT

Provided is a printing apparatus having a printing unit with recording elements arranged in a width direction of a print medium. The printing apparatus includes a printer printing a correcting chart to the print medium, a correcting-chart density information obtaining device obtaining density information on the correcting chart printed to the print medium, and a print-medium deformation determining device setting at least two different numbers of the recording elements as moving average widths from the density information on the correcting chart, calculating moving average values of the density information of the recording elements for the moving average widths, calculating a standard deviation using the moving average values for the small and large moving average widths, respectively, and determining that deformation occurs in the print medium when the standard deviation used as a determination value exceeds a threshold.

20 Claims, 11 Drawing Sheets

CORRECTING CHART PRINTED TO FIRST WEB PAPER

CORRECTING CHART PRINTED TO FIRST WEB PAPER
(WITH COCKLING)

DENSITY INFORMATION OF FIRST WEB PAPER
(WITH MOVING AVERAGE WIDTH OF 50)

DENSITY INFORMATION OF FIRST WEB PAPER
(WITH MOVING AVERAGE WIDTH OF 500)

DENSITY INFORMATION OF SECOND WEB PAPER
(WITH MOVING AVERAGE WIDTH OF 50)

DENSITY INFORMATION OF SECOND WEB PAPER
(WITH MOVING AVERAGE WIDTH OF 500)

Fig.12

| PAPER TYPE | DENSITY AVERAGE VALUE Dav | VARIATION RATE 3σ | VARIATION RATE RV | DEFORMATION DETERMINATION |
|---|---|---|---|---|
| FIRST TYPE | 1.778 | 0.035 | 1.969 | ABSENCE |
| FIRST TYPE | 1.673 | 0.037 | 2.212 | ABSENCE |
| SECOND TYPE | 1.712 | 0.080 | 4.673 | PRESENT |
| SECOND TYPE | 1.674 | 0.071 | 4.241 | PRESENT |

PRINT MEDIUM DEFORMATION DETECTING METHOD

TECHNICAL FIELD

The present invention relates to a printing apparatus forming images on a print medium with a printing unit having a plurality of recording elements, and a detecting method detecting deformation of the print medium.

BACKGROUND ART

Examples of currently-used apparatus of the above type include an inkjet printing apparatus discharging ink droplets to print images on web paper.

Such an inkjet printing apparatus includes an inkjet head having a plurality of nozzles arranged in a width direction of the web paper. The inkjet head discharges the ink droplets, whereby the images are formed. However, the nozzles have a variation in ink discharge characteristic. Accordingly, shading correction is typically made for correcting the variation of the characteristic. Specifically, a correcting chart with a given density is printed. Thereafter, the printed correcting chart is optically read for determining densities of portions of the web paper corresponding to the nozzles individually. Then difference between the densities and the given density is calculated, and the nozzle is each corrected in accordance with the difference. This achieves a printing result having the same density for all the nozzles. See, for example, Japanese Unexamined Patent Publication No. 2014-27527A.

Note that an undulation phenomenon called cockling occurs on a surface of web paper upon transportation. The cockling is caused by swelling of a sheet due to ink droplet discharge or by dry treatment. This may result in deformation on the paper. The deformation of the web paper causes influences on optical reading of the correcting chart. Consequently, a shading difference in density occurs among the portions of the web paper corresponding to the nozzles depending on the deformation. If shading correction is performed based on density values determined under such a condition, this results in miss-correction to perform improper correction. Experience shows that the deformation occurs in a certain correlation with a printing condition such as present or absence of previous application to the web paper or a paper thickness. Accordingly, when an operator determines that the printing condition is likely to induce deformation, he/she changes a processing condition upon the shading correction for eliminating adverse effects caused by the deformation.

However, only the printing condition is not sufficient for determining whether or not the deformation occurs. Then, a device for detecting occurrence of the deformation has been suggested. See, for example, Japanese Unexamined Patent Publication No. 2001-41726A. The device detects the deformation optically while web paper is wound.

However, the example of the currently-used device with such a construction has the following drawback.

That is, the currently-used device determines deformation while the web paper is wound. As a result, the device is not applicable to a printing apparatus, for example, when deformation occurs upon transportation. Consequently, the device cannot detect occurrence of the deformation on the web paper. Such a drawback may arise.

SUMMARY OF THE INVENTION

The present invention has been made regarding the state of the art noted above, and its one object is to provide a printing apparatus that allows accurate detection of deformation of a print medium by performing image processing to a read correcting chart as well as a detecting method of detecting the deformation of the print medium.

In order to accomplish the above object, the present invention adopts the following construction.

One aspect of the present invention provides a printing apparatus having a printing unit with plurality of recording elements arranged in a width direction of a print medium. The printing apparatus includes a printer printing a correcting chart for correcting recording densities for the recording elements to the print medium, a correcting-chart density information obtaining device obtaining density information on the correcting chart printed individually to the print medium, and a print-medium deformation determining device. The print-medium deformation determining device sets at least two different numbers of successive recording elements among the recording elements as moving average widths in accordance with the density information on the correcting chart, calculates moving average values of the density information of the recording elements for the moving average widths, calculates a standard deviation using one of the moving average values for a first small moving average width of the moving average widths as actual measurement data and using another one of the moving average values for a second large moving average width of the moving average widths as an average value of the actual measurement data, and determines that deformation occurs in the print medium when the standard deviation used as a determination value exceeds a threshold.

With the aspect of the present invention, the print-medium deformation determining device sets at least two different numbers of successive recording elements among the recording elements are set as the moving average widths in accordance with the density information on the correcting chart printed with the printer and obtained by the correcting-chart density-information obtaining device. Then the moving average values of the density information of the recording elements are calculated for the moving average widths, respectively. The moving average value for the small moving average width is determined as the actual measurement data. The moving average value for the large moving average width is determined as the average value of the actual measurement data. The standard deviation is determined based on the above. Such a standard deviation represents a deviation of the moving average value for the small moving average width of the density information relative to the moving average value for the large moving average width of the density information. The average values originally contain variations in density of the recording elements. Accordingly, the deviation is caused by the deformation of the print medium having the correcting chart printed thereon. Consequently, the standard deviation is used as the determination value, and the deformation is determinable accurately when the determination value exceeds the threshold.

Moreover, it is preferred that the print-medium deformation determining device according to the aspect of the present invention calculates a density average value for the moving average value of the small moving average width, and sets a rate of the standard deviation relative to the density average value as the determination value.

The density information may be variable depending on types of the print medium when the correcting chart is printed in the same density. Consequently, the standard deviation varies depending on the types of the print medium. Accordingly, under such a condition, error determination may be made using only the standard deviation as the determination value. Then, the density average value is calculated in accordance with the moving average value for the small moving average width, and a rate of the standard deviation relative to the density average value is used as the determination value. This allows accurate determination of the deformation regardless of the types of the print medium.

Moreover, it is preferred that the printing apparatus according to the aspect of the present invention further includes a recording-element density correcting device correcting the recording densities of the recording elements in accordance with the density information of the moving average widths depending on the deformation of the print medium when the print-medium deformation determining device determines that the deformation occurs.

When the print-medium deformation determining device determines that the print medium contains the deformation, shading correction in which the recording densities of the recording elements are corrected directly in accordance with the density information leads to miss-correction. Then, the recording-element density correcting device corrects the recording densities of the recording elements in accordance with the density information of the moving average width depending on the deformation.

Here, the density information of the moving average width depending on the deformation corresponds to the density information on the moving average width larger than a cycle of the shading difference in the correcting chart caused by the deformation. If the shading correction is performed based on the density information of the moving average width smaller than the cycle of the shading difference in the correcting chart caused by the deformation, the shading correction is influenced by the shading difference. In contrast to this, using the density information of the moving average width larger than the cycle of the shading difference yields the accurate shading correction with the suppressed adverse effects of the deformation.

Moreover, another aspect of the present invention provides a detecting method of detecting deformation of a print medium by a printing apparatus having a printing unit with a plurality of recording elements arranged in a width direction of the print medium. The method includes a printing step of printing a correcting chart for correcting recording densities of the recording elements individually to the print medium, a density information obtaining step of obtaining density information on the correcting chart printed to the print medium, a moving average-value calculating step of setting at least two different numbers of successive recording elements among the recording elements as moving average widths in accordance with the density information on the correcting chart, and calculating moving average values of the density information of the recording elements for the moving average widths, a standard deviation calculating step of calculating a standard deviation using one of the moving average values for a first small moving average width of the moving average widths as actual measurement data and using another one of the moving average values for a second large moving average width of the moving average widths as an average value of the actual measurement data, and a determining step of determining that the deformation occurs in the print medium when the standard deviation as a determination value exceeds a threshold.

With the other aspect of the present invention, the density information of the correcting chart printed in the printing step is obtained in the density information obtaining step. In the moving average-value calculating step, at least two different numbers of successive recording elements among the recording elements are set as the moving average widths in accordance with the density information on the correcting chart, and the moving average values of the density information for the recording elements are calculated for the moving average widths individually. Then, in the standard deviation calculating step, the standard deviation is calculated using the moving average value for the small moving average width as the actual measurement data and using the moving average value for the large moving average width as the average value of the actual measurement data. Here, the standard deviation represents a deviation of the moving average value for the small moving average width relative to the moving average value for the large moving average width. The average values originally contain variations in density of the recording elements originally. Accordingly, the deviation is derived from the deformation of the print medium having the correcting chart printed thereto. Consequently, in the determining step, it is accurately determined that the deformation occurs when the standard deviation as the determination value exceeds the threshold.

Moreover, the other aspect of the present invention further includes, prior to the determining step, a density average-value calculating step of calculating a density average value for the moving average value for the small moving average width, and a variation rate calculating step of calculating a variation rate of the standard deviation relative to the density average value. In the determining step, the rate is used as the determination value.

In the density average-value calculating step, the density average value is calculated in accordance with the moving average value for the small moving average width. In the variation rate calculating step, the rate of the standard deviation relative to the density average value is calculated. In the determining step, the rate is used as the determination value. This yields accurate determination of the deformation regardless of the types of the print medium.

BRIEF DESCRIPTION OF DRAWINGS

For the purpose of illustrating the invention, there are shown in the drawings several forms which are presently preferred, it being understood, however, that the invention is not limited to the precise arrangement and instrumentalities shown.

FIG. 12 illustrates calculation results of a variation rate and the like.

DESCRIPTION OF EMBODIMENTS

The following describes one embodiment of the present invention with reference to drawings.

Figure 1:
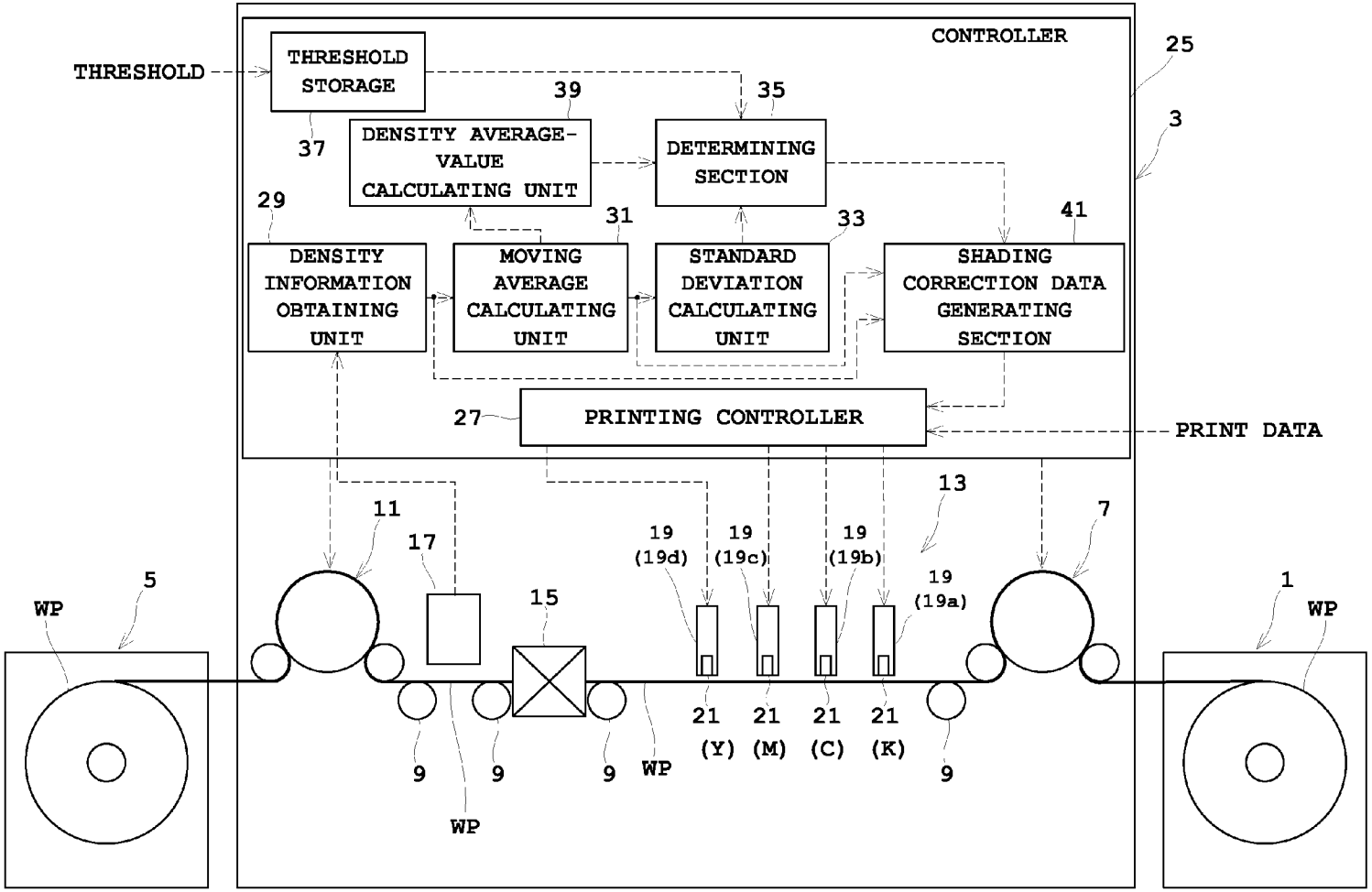
FIG. 1 schematically illustrates an overall configuration of an inkjet printing system according to one embodiment of the present invention.
Figure 2:
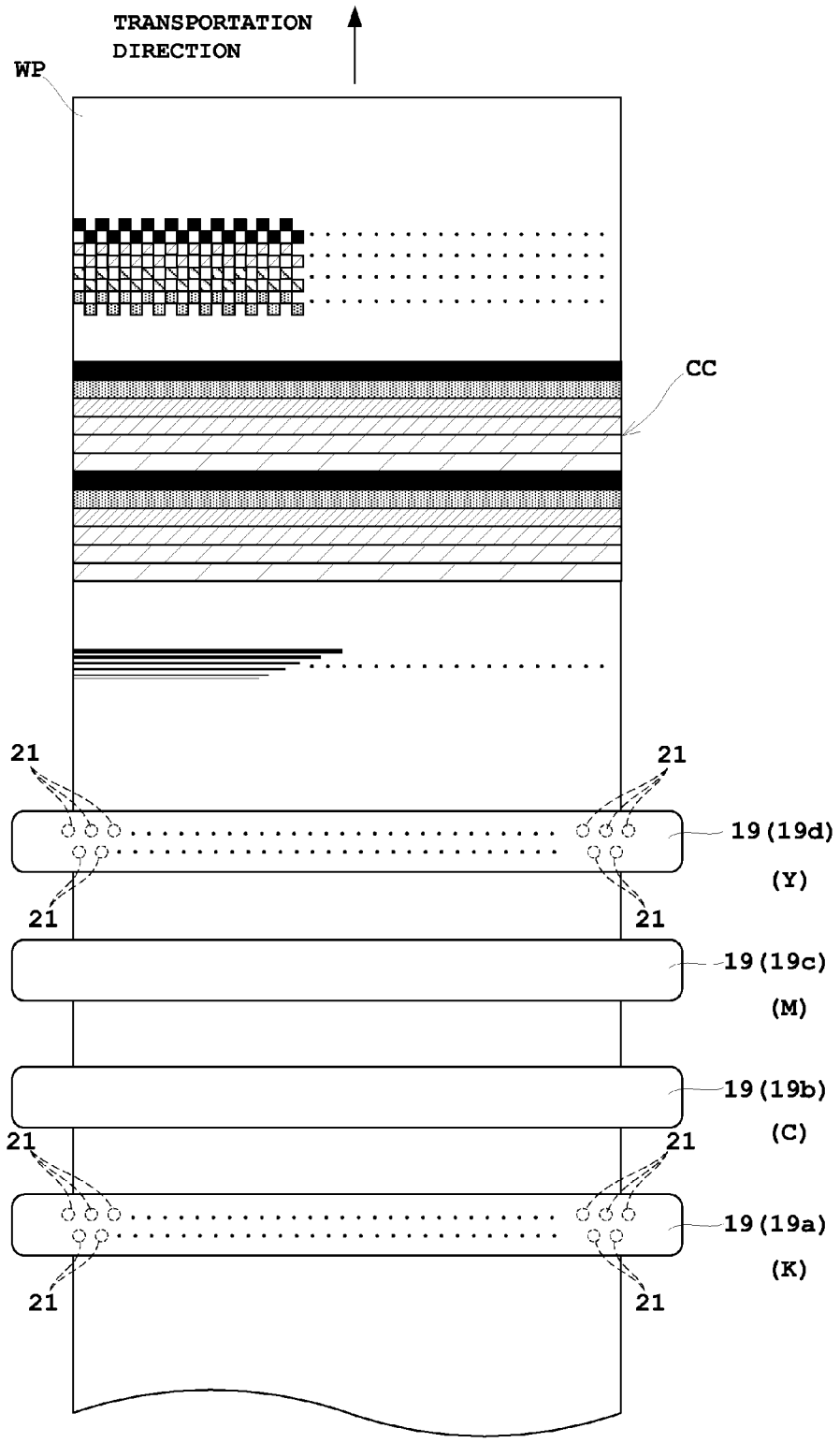
FIG. 2 is a plan view of a positional relationship between web paper and printing heads.

FIG. 1 schematically illustrates an overall configuration of an inkjet printing system according to one embodiment of the present invention. FIG. 2 is a plan view of a positional relationship between web paper and printing heads.

The inkjet printing system according to one embodiment of the present invention includes a paper feeder 1, an inkjet printing apparatus 3, and a take-up roller 5.

The paper feeder 1 holds long web paper WP to be rotatable in a roll form about a horizontal axis. The paper feeder 1 unwinds and feeds the web paper WP to the inkjet printing apparatus 3. The take-up roller 5 winds up the web paper WP printed by the inkjet printing apparatus 3 about a horizontal axis. Regarding the side from which the web paper WP is fed as upstream and the side to which the web paper WP is fed out as downstream, the paper feeder 1 is disposed upstream of the inkjet printing apparatus 3, whereas the take-up roller 5 is disposed downstream of the inkjet printing apparatus 3.

The inkjet printing apparatus 3 includes a drive roller 7 upstream thereof for taking in the web paper WP from the paper feeder 1. The web paper WP unwound from the paper feeder 1 by the drive roller 7 is transported downstream toward the take-up roller 5 along a plurality of transport rollers 9. A drive roller 11 is disposed between the most downstream transport roller 9 and the take-up roller 5. The drive roller 11 feeds the web paper WP travelling on the transport rollers 9 toward the take-up roller 5.

The inkjet printing apparatus 3 corresponds to the "printing apparatus" in the present invention. The web paper WP corresponds to the "print medium" in the present invention.

Between the drive rollers 7 and 11, the inkjet printing apparatus 3 includes a print unit 13, a drier 15, and an inspecting unit 17 arranged in this order from upstream. The drier 15 dries portions of the web paper WP printed by the print unit 13. The inspecting unit 17 inspects the printed portions for any stains or omissions. The inspecting unit 17 reads a correcting chart, mentioned later, and converts the correcting chart into density information.

The print unit 13 has a plurality of printing heads 19 for discharging ink droplets. In the present embodiment, one example is to be described with four printing heads 19. The four print heads 19 are a printing head 19*a*, a printing head 19*b*, a printing head 19*c*, and a printing head 19*d* in this order from the upstream. In this specification, when the printing head 19 should be identified individually, an alphabetical numeral (e.g., a) is applied to the numeral 19. Otherwise, only the numeral 19 is indicated. The printing heads 19 each have a plurality of inkjet nozzles 21 for discharging ink droplets.

The inkjet nozzles 21 are arranged in a transportation direction of the web paper WP and in an orthogonal direction to the transportation direction of the web paper WP (width direction of the web paper WP). The printing heads 19*a* to 19*d* discharge ink droplets in at least two colors, and allows multi-color printing on the web paper WP. For instance, the printing head 19*a* discharges ink droplets in black (K), the printing head 19*b* discharges ink droplets in cyan (C), printing head 19*c* discharges ink droplets in magenta (M), and the printing head 19*d* discharges ink droplets in yellow (Y). The printing heads 19*a* to 19*d* are each spaced away from one another at given intervals in the transportation direction.

The printing head 19 corresponds to the "printing unit" in the present invention. The nozzles 21 correspond to the "recording elements" in the present invention.

A controller 25 includes a CPU and a memory not shown. Specifically, the controller 25 includes a printing controller 27, a density information obtaining unit 29, a moving average calculating unit 31, a standard deviation calculating unit 33, a determining section 35, a threshold storage 37, a density average-value calculating unit 39, and a shading correction data generating section 41.

The printing controller 27 receives print data from an external computer, not shown, and converts the print data into print-processing data. Thereafter, the printing controller 27 operates the drive rollers 7 and 11 to transport the web paper WP while the printing heads 19 discharge ink droplets in accordance with the print-processing data, whereby an image based on the print data is printed on the web paper WP. The controller 25 stores in advance the print-processing data on the correcting chart for correcting the densities for the nozzles 21. When an operator of the inkjet printing system issues a command to print the inspecting chart, the controller 25 reads the print-processing data on the correcting chart, and operates the drive rollers 7, 11 and the printing heads 19 to print the correcting chart on the web paper WP. FIG. 2 illustrates in detail a correcting chart CC as one example of the correcting chart. For instance, the nozzles 21 in the width direction of the web paper WP discharge ink droplets in the same printing density to the correcting chart CC. The nozzles 21 discharges ink droplets at a given length in the transportation direction of the web paper WP, and thereafter discharges ink droplets in printing densities gradually decreasing.

Here, the printing heads 19 and the printing controller 27 correspond to the "printer" in the present invention.

Figure 3A:
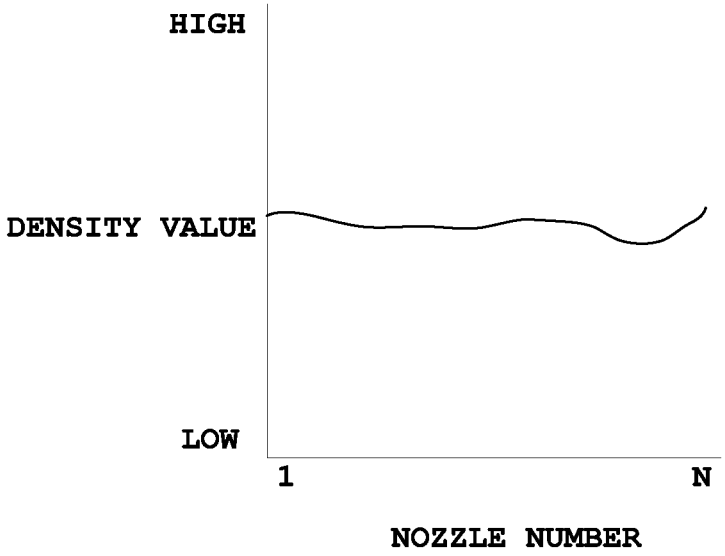
FIGS. 3A and 3B each schematically illustrate shading correction.
Figure 3A:
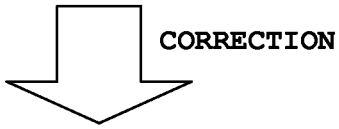
Figure 3B:
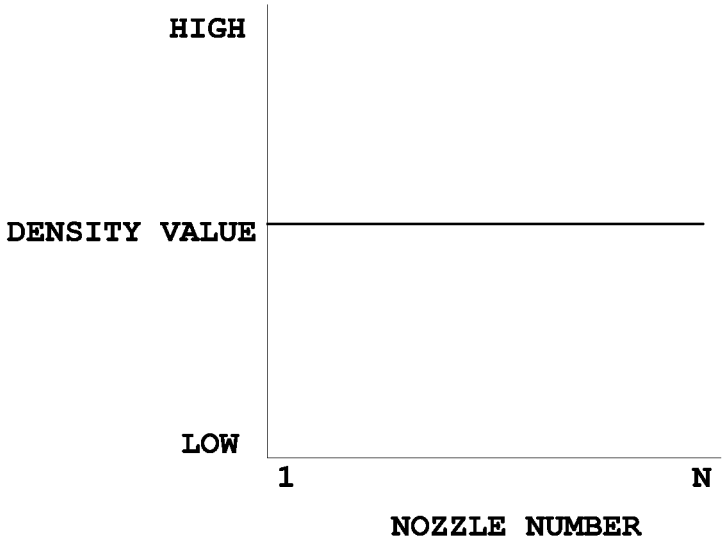

Now reference is made to FIG. 3. FIGS. 3A and 3B are each schematic views of shading correction.

As mentioned above, the printing heads 19 each includes the nozzles 21 arranged orthogonal to the transportation direction of the web paper WP. The nozzle 21 typically has a variation in discharge characteristic. Accordingly, as illustrated in FIG. 3A, the nozzles 21 cause various density values even when a command is issued to perform printing in the same density. Then a correcting chart CC with strip patterns of various densities (e.g., 100%, 80%, 60%, 40%, 20%, and 5%) is printed on the web paper WP, and the inspecting unit 17 reads the correcting chart CC. Thereafter, the density information obtaining unit 29 obtains density information. The density values of the nozzles 21 are read from the density information to give a signal to perform printing in the same density. Upon this, a shading coefficient is determined to make the same density value for all the nozzles 21 as illustrated in FIG. 3B. The shading correction data generating section 41 performs this process. The printing controller 27 converts the print data into the print-processing data while reflecting the results, and performs printing based on the print-processing data.

The inspecting unit 17 and the density information obtaining unit 29 corresponds to the "correcting-chart density-information obtaining device" in the present invention. The printing controller 27 corresponds to the "recording-element density correcting device" in the present invention.

Now reference returns to FIG. 1. The density information obtaining unit 29 obtains density information on all the nozzles 21 from the correcting chart CC read by the inspecting unit 17. The moving-average calculating unit 31 sets at least two different numbers of nozzles 21 among the successive nozzles 21 arranged orthogonal to the transportation direction of the web paper WP, as the moving average widths, and calculates moving average values of the density information with the two moving average widths. Here, it is assumed that the moving average widths are two types of 50 and 500. The moving average widths are not limited to two types, but may be three or more types. In the following process in the present embodiment, two types are used. The two moving average widths to be selected are preferably set taking into consideration of a cycle of the variation of the nozzles 21, and a cycle of deformation, such as cockling, for easy determination.

The standard deviation calculating unit 33 uses the moving average value for the small moving average width from the moving average values of the moving average widths as the actual measurement data in a formula for calculating the standard deviation, whereas uses the moving average value for the large moving average width as the average value in the formula for calculating the standard deviation, whereby the standard deviation is calculated. For instance, a moving average value for a moving average width of 50 is denoted by Dma1, and a moving average value for a moving average width of 500 is denoted by Dma2.

Then a standard deviation SD is calculated from the following formula (1):

$$SD = \sqrt{\frac{1}{n}\sum_{i=1}^{n}(Dma1_i - Dma2_i)^2} \quad (1)$$

The determining section 35 compares a rate (variation rate) of the density average value relative to the standard deviation SD, determined from the density average value by the density average-value calculating unit 39 and the standard deviation SD by the standard deviation calculating unit 33, and the threshold stored in advance in the threshold storage 37. As a result, if the variation rate exceeds the threshold, it is determined that deformation such as cockling occurs in the web paper WP.

The density average-value calculating unit 39 calculates the density average value. Specifically, a density average value Dav is calculated for the moving average value Dma1 of the small moving average width from the following formula (2):

$$Dav = \frac{1}{n}\sum_{i=1}^{n} Dma1_i \quad (2)$$

The determining section 35 calculates the variation rate as above from the following formula (3):

$$\text{variation rate } RV=(3SD/Dav)\times 100\ [\%]\ \ldots \quad (3)$$

The above threshold may be determined appropriately based on samples of the web paper, having the correcting chart CC printed in advance thereon, with deformation such as cockling and with no deformation.

The moving-average calculating unit 31, the standard deviation calculating unit 33, the determining section 35, and the density average-value calculating unit 39 correspond to the "print-medium deformation determining device" in the present invention.

Figure 4:
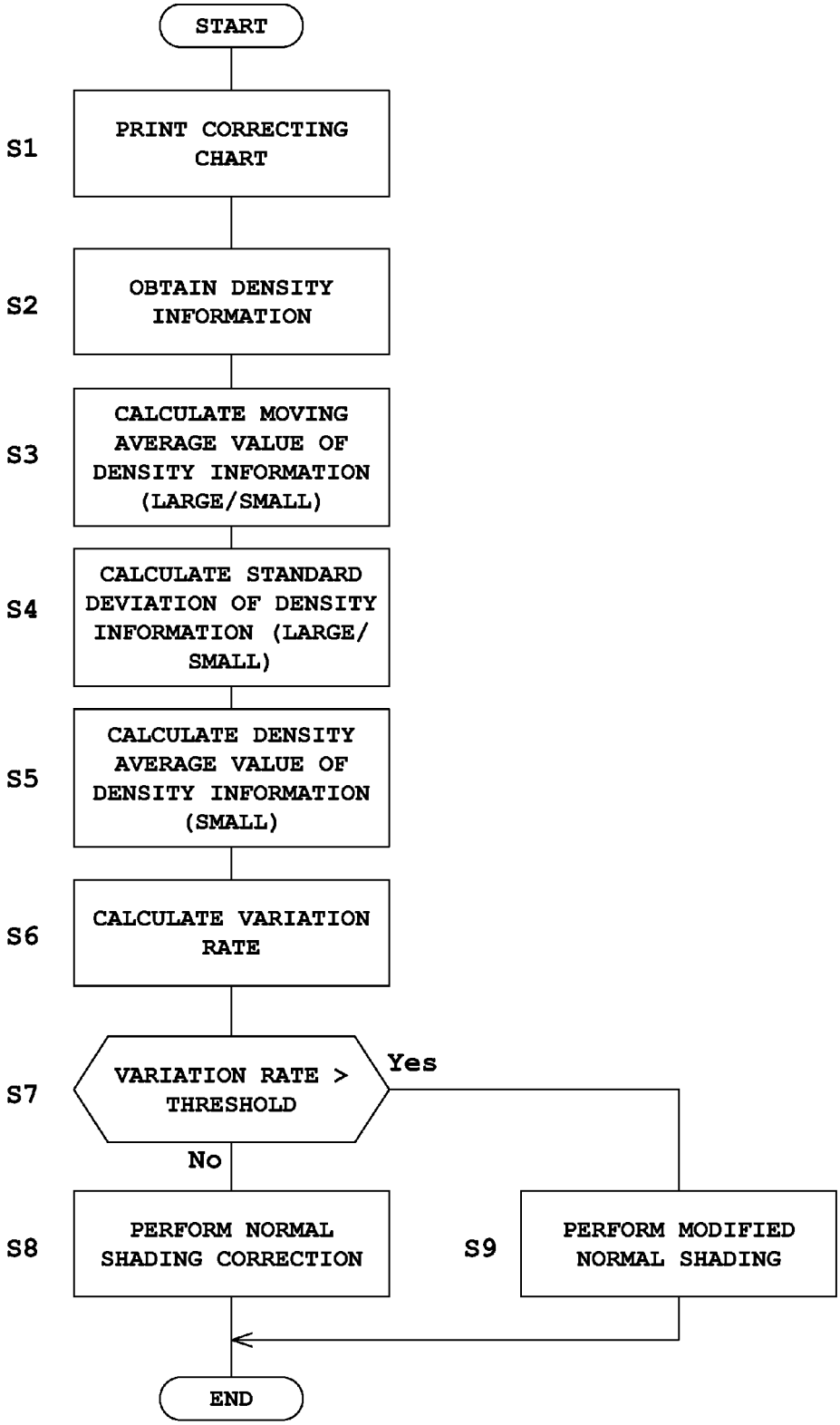
FIG. 4 is a flow chart of the shading correction.

The following describes shading correction with reference to FIG. 4 taking into consideration the deformation of the web paper WP in the inkjet printing system. FIG. 4 is a flow chart of the shading correction.

Step S1 (Printing Step)

The controller 25 prints the correcting chart CC as in FIG. 2 to the web paper WP.

Step S2 (Density Information Obtaining Step)

Then the density information (raw data) on the correcting chart CC associated with all the nozzles 21 is obtained with the inspecting unit 17 and the density information obtaining unit 29.

Figure 5:
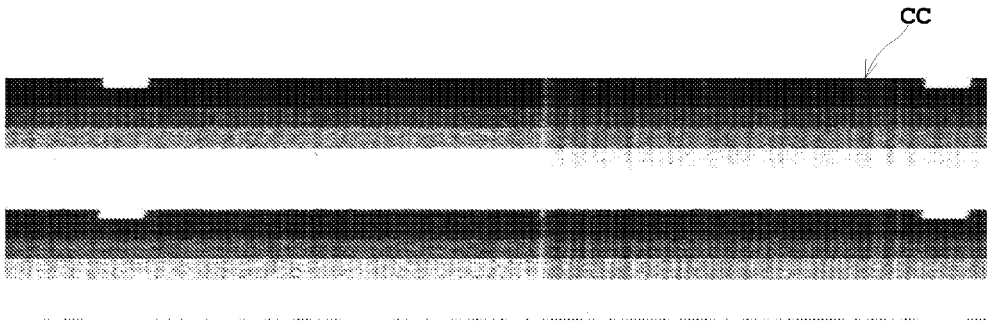
FIG. 5 schematically illustrates a read correcting chart printed to first web paper.
Figure 6:
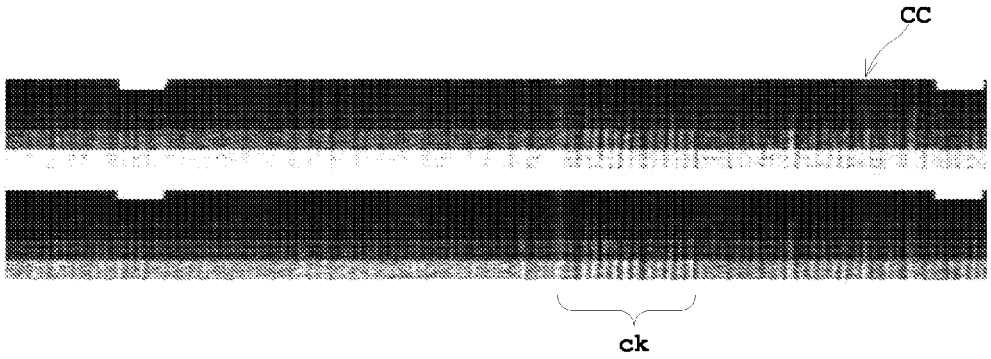
FIG. 6 schematically illustrates a read correcting chart printed on second web paper.

Now reference is made to FIGS. 5 and 6. FIG. 5 is a schematic view with the read correcting chart printed to first web paper. FIG. 6 is a schematic view with the read correcting chart printed to second web paper. Here, an example of the web paper for the first and second web paper WP having different likelihood of deformation such as cockling has been described so as to be compared easily.

Comparison between the correcting charts CC in FIGS. 5 and 6 reveals that the correcting chart CC in FIG. 6 includes portions in which density unevenness in vertical lines are more significant than portions in FIG. 5. The density unevenness is unavoidable due to the variation in discharge characteristic of the nozzles 21. The significant density unevenness is caused by the deformation of the web paper WP such as cockling. In the present embodiment, the second web paper WP contains unevenness caused by the deformation around a region ck.

Step S3 (Moving Average Value Calculating Step)

The moving average-value calculating unit 31 calculates moving average values of the two moving average widths for the density information (raw data). Here, as mentioned above, the moving average-value calculating unit 31 calculates Dma1 with a moving average width of 50 and Dma2 with a moving average width of 500.

Figure 7:
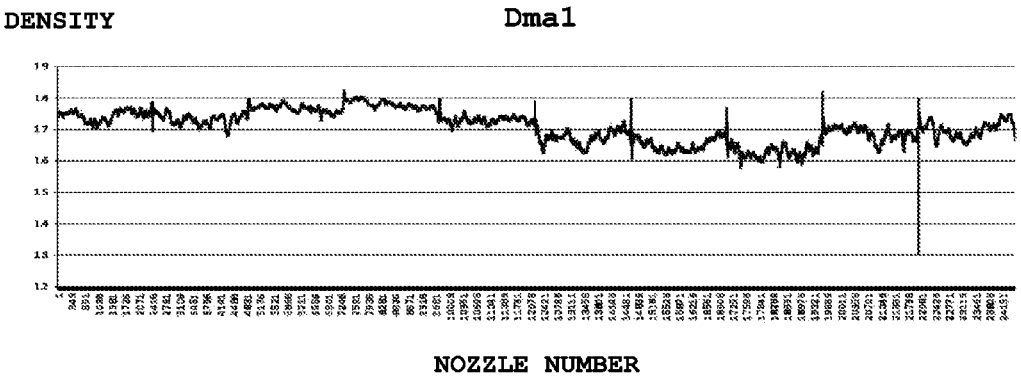
FIG. 7 is a graph illustrating density information of the first web paper (with moving average width of 50).
Figure 8:
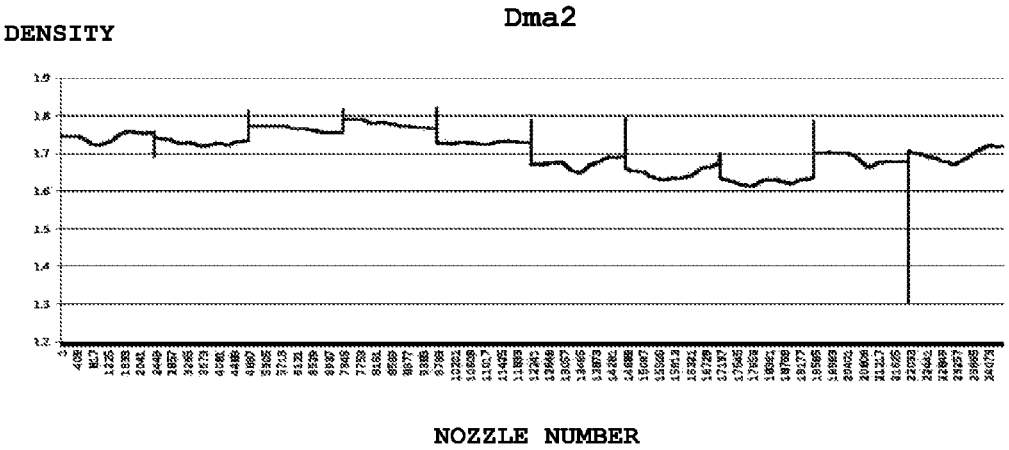
FIG. 8 is a graph illustrating density information of the first web paper (with moving average width of 500).
Figure 9:
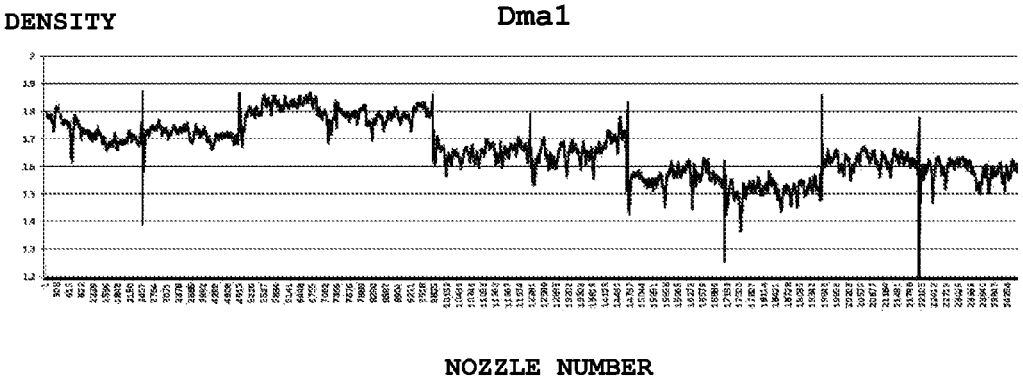
FIG. 9 is a graph illustrating density information of the second web paper (with moving average width of 50).
Figure 10:
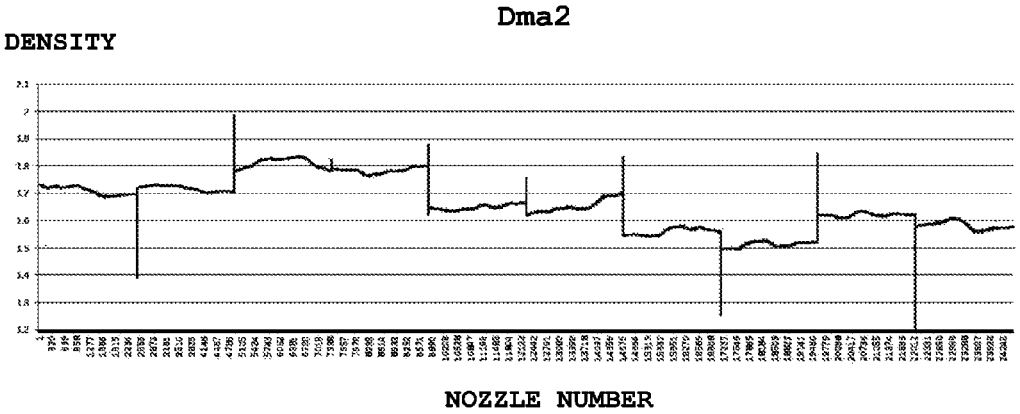
FIG. 10 is a graph illustrating density information of the second web paper (with moving average width of 500).

The following describes detailed calculation results with reference to FIGS. 7 to 10. FIG. 7 is a graph illustrating density information (moving average width of 50) of the first web paper. FIG. 8 is a graph illustrating density information (moving average width of 500) of the first web paper. FIG. 9 is a graph illustrating density information (moving average width of 50) of the second web paper. FIG. 10 is a graph illustrating density information (moving average width of 500) of the second web paper.

Step S4 (Standard Deviation Calculating Step)

Figure 11:
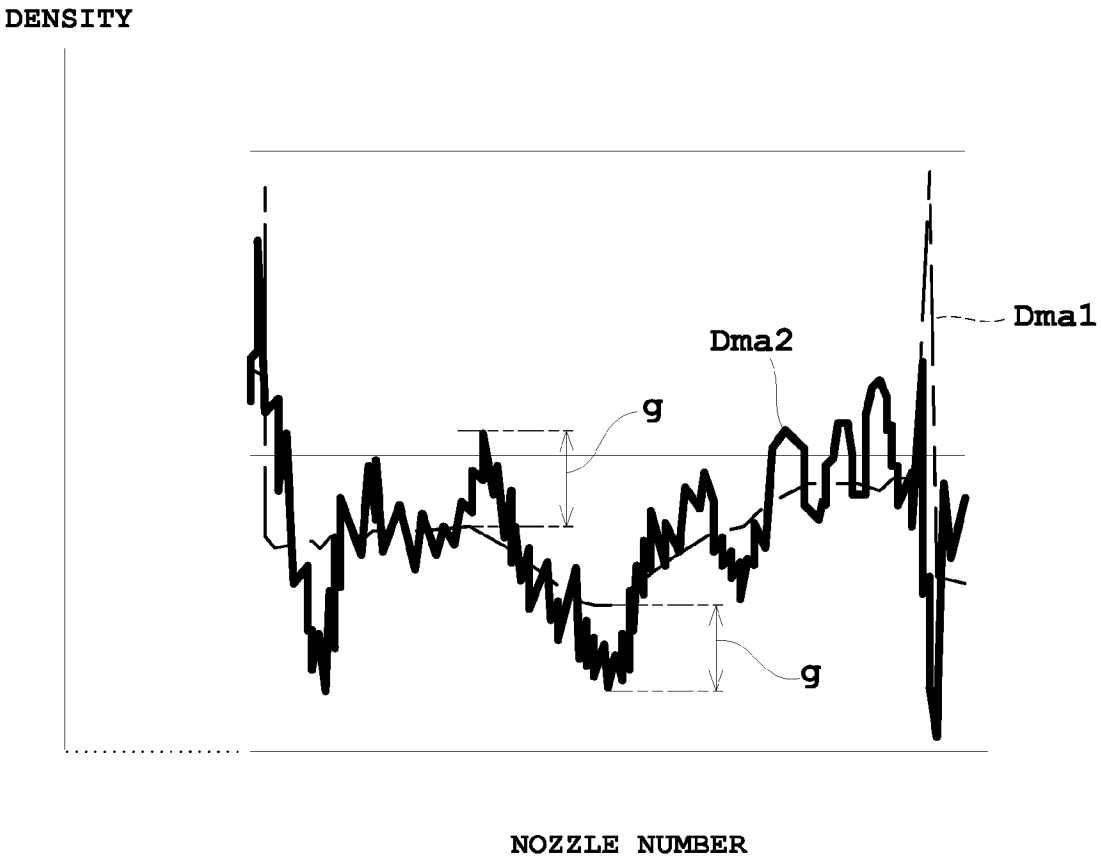
FIG. 11 is an explanatory view of moving average.

The standard deviation calculating unit 33 calculates a standard deviation SD in accordance with the moving average values of the two moving average widths. The standard deviation SD is calculated by the above formula (1) which slightly differs from how the standard deviation is commonly determined. The standard deviation SD is different from the common concept of the standard deviation as illustrated in FIG. 11 for explanation of moving average. In other words, the standard deviation SD in the present embodiment represents a deviation in difference g between a large moving average value and a small moving average value. These two moving average values originally contain the variations in density for all the nozzles 21. The deformation such as cockling is typically larger than an interval of adjacent nozzles 21. Consequently, the deformation is likely to influence the small moving average value, whereas is unlikely to influence the large moving average value. As a result, the deviation is derived from the deformation of the web paper WP with the printed correcting chart CC printed thereto. Consequently, it is determinable whether or not the deformation such as cockling occurs in the web paper WP in accordance with the standard deviation SD calculated in the above manner.

Step S5 (Density Average Value Calculating Step)

The density average-value calculating unit 39 calculates a density average value Dav of a small moving average width Dma1 from the above formula (2).

Step S6 (Variation Rate Calculating Step)

The determining section 35 calculates a variation rate RV from the above formula (3). The density information sometimes varies for the types of web paper WP even when the correcting chart CC in the same density is printed. Consequently, the standard deviation SD largely varies depending on the types of web paper WP. Accordingly, under such a condition, error determination may be made using only the standard deviation for the determination value. Then, a density average value Dav is calculated in accordance with the moving average value Dma1 of the smaller moving average width. Then a variation rate RV as a rate of 3 σ, i.e., three times the standard deviation SD, relative to the density average value Dav is used as the determination value. Consequently, the deformation is accurately determinable regardless of the types of web paper WP.

Step S7 (Determining Step)

The determining section 35 branches processing in accordance with the comparison result between the variation rate RV and the threshold. If the variation rate RV falls below the threshold, the process is branched to a step S8. If the variation rate RV exceeds the threshold, the process is branched to a step S9. As in FIG. 12 illustrating detailed calculation results such as the variation rate, a threshold of around 3 yields accurate determination of the deformation at the variation rate RV.

Step S8

The shading correction data generating section 41 generates a normal shading coefficient taking into no consideration the deformation such as cockling.

Step S9

The shading correction data generating section 41 generates a shading coefficient taking into consideration of the deformation, such as cockling, in the web paper WP. Specifically, a shading coefficient is generated based on the density information of the moving average width depending on the deformation. That is, a shading coefficient is generated in accordance with the moving average value for the large moving average width of the density information.

Here, the density information of the moving average width depending on the deformation corresponds to density information of the moving average width larger than a cycle of the shading difference in the correcting chart CC caused by the deformation. If the shading correction is performed based on the density information of the moving average width smaller than the cycle of the shading difference in the correcting chart CC caused by the deformation, the shading correction is largely influenced by the shading difference. In contrast to this, the shading correction with the density information of the moving average width larger than the cycle of the shading difference allows accurate shading correction with suppressed influence of the deformation.

As noted above, the shading coefficient is generated in advance while the correcting chart CC is printed on the web paper WP, and then the printing controller 27 performs printing to the web paper WP using the shading coefficient. Consequently, high-quality printing is performable taking into consideration the deformation, such as cockling, to the web paper WP while the density unevenness caused by the different discharge characteristics of the nozzles 21 is suppressed.

Figure 13:
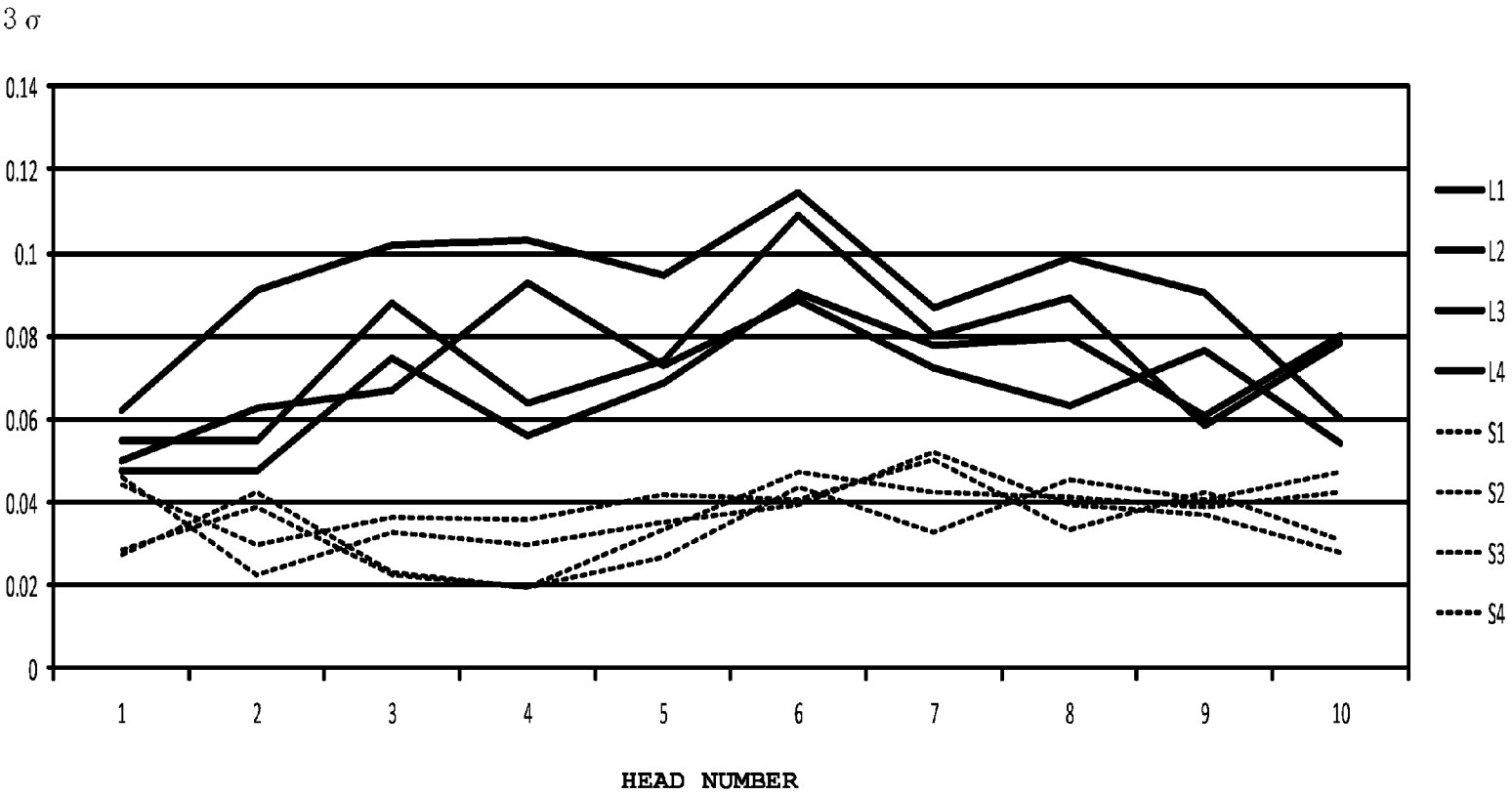
FIG. 13 is a graph illustrating a standard deviation of 3 $\sigma$.
Figure 14:
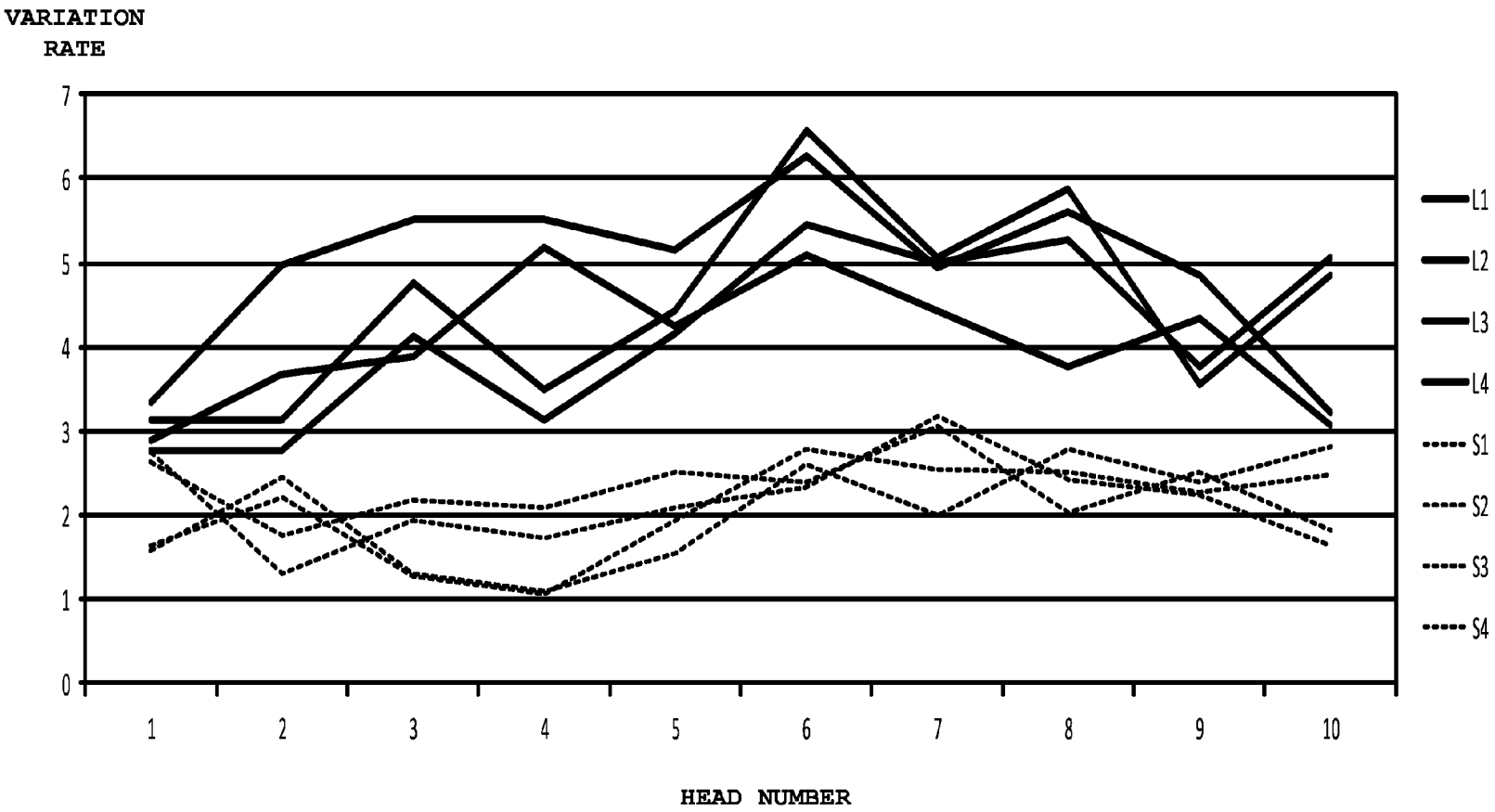
FIG. 14 is a graph illustrating the variation rate.

Now reference is made to FIGS. 13 and 14. FIG. 13 is a graph of the standard deviation of 3 σ. FIG. 14 is a graph of the variation rate. These graphs each include L1 to L4 indicating samples of the first web paper WP, and S1 to S4 indicating samples of the second web paper WP.

FIG. 13 illustrates the standard deviation of 3 σ, and allows distinguishment of the first web paper WP from the second web paper WP. However, comparison to the variation rate in FIG. 14 reveals that a gap of the results between the two types of web paper WP is smaller. This results in possibility to cause error determination caused by difficulty in setting the threshold when the standard deviation of 3 σ is used as the determination value. In contrast to this, it is revealed from the variation rate in FIG. 14 that a gap of the results between the two types of web paper WP is larger than that in FIG. 13. Accordingly, it is found that the threshold is readily settable.

With the present embodiment, the controller 25 sets at least two different numbers of successive nozzles 21 among the nozzles 21 as the moving average widths in accordance with the density information of the correcting chart CC printed with the printing head 19 and obtained by the inspecting unit 17 and the density information obtaining unit 29. Thereafter, the moving average values of the density information of the nozzles 21 are determined for the moving average widths individually.

Then, the standard deviation SD is calculated in accordance with the moving average value Dma1 of the small moving average width as the actual measurement data and the moving average value Dma2 of the large moving average width as the average value of the actual measurement data. The standard deviation SD indicates the deviation of the moving average value Dma2 of the small moving average width relative to the moving average value Dma1 of the large moving average width. The moving average values originally contain the variation in density of the nozzles 21. Accordingly, the deviation is derived from the deformation of the web paper WP with the correcting chart CC printed thereto. Consequently, the standard deviation SD is used as the determination value. It is accurately determinable that the deformation occurs when the determination value exceeds the threshold. As a result, the nozzle discharge characteristics can be corrected accurately, leading to enhanced printing quality.

The present invention is not limited to the foregoing examples, but may be modified as follows.

(1) In the embodiment mentioned above, the variation rate RV as three times the standard deviation SD relative to the density average value Dav is used as the determination value. Alternatively, the standard deviation SD may be simply used as the determination value depending on the types of web paper WP to be used. This allows structural omission of the density average-value calculating unit 39, leading to reduction in apparatus cost.

(2) In the embodiment mentioned above, the inkjet printing apparatus 3 has been described as one example of the printing apparatus. However, the present invention is not limitedly applied to such a printing apparatus. That is, the present invention is applicable to a printing apparatus requiring correction of the variation in density.

(3) In the embodiment mentioned above, the web paper WP has been described as one example of the print medium. Alternatively, the present invention is applicable to a print medium other than the above type. Examples of other types of the print medium include a film and cut-form paper.

The present invention may be embodied in other specific forms without departing from the spirit or essential attributes thereof and, accordingly, reference should be made to the appended claims, rather than to the foregoing specification, as indicating the scope of the invention.

What is claimed is:

1. A printing apparatus having a printing unit with plurality of recording elements arranged in a width direction of a print medium, the printing apparatus comprising:

a printer printing a correcting chart for correcting recording densities for the recording elements to the print medium;

a correcting-chart density information obtaining device obtaining density information on the correcting chart printed to the print medium; and a print-medium deformation determining device, the print-medium deformation determining device setting at least two different numbers of successive recording elements among the recording elements as moving average widths in accordance with the density information on the correcting chart, calculating moving average values of the density information of the recording elements for the moving average widths, calculating a standard deviation using one of the moving average values for a first small moving average width of the moving average widths as actual measurement data and using another one of the moving averages value for a second large moving average width of the moving average widths as an average value of the actual measurement data, and determining that deformation occurs in the print medium when the standard deviation used as a determination value exceeds a threshold.

2. The printing apparatus according to claim 1, wherein the print-medium deformation determining device calculates a density average value for the moving average value of the small moving average width, and sets a rate of the standard deviation relative to the density average value as the determination value.

3. The printing apparatus according to claim 2, further comprising:

a recording-element density correcting device correcting the recording densities of the recording elements in accordance with the density information of the moving average widths depending on the deformation of the print medium when the print-medium deformation determining device determines that the deformation occurs.

4. The printing apparatus according to claim 3, wherein the recording elements are of an inkjet type discharging ink droplets.

5. The printing apparatus according to claim 4, wherein the print medium is long web paper.

6. The printing apparatus according to claim 2, wherein the recording elements are of an inkjet type discharging ink droplets.

7. The printing apparatus according to claim 6, wherein the print medium is long web paper.

8. The printing apparatus according to claim 2, wherein the print medium is long web paper.

9. The printing apparatus according to claim 3, wherein the print medium is long web paper.

10. The printing apparatus according to claim 1, further comprising:

a recording-element density correcting device correcting the recording densities of the recording elements in accordance with the density information of the moving average widths depending on the deformation of the print medium when the print-medium deformation determining device determines that the deformation occurs.

11. The printing apparatus according to claim 10, wherein the recording elements are of an inkjet type discharging ink droplets.

12. The printing apparatus according to claim 11, wherein the print medium is long web paper.

13. The printing apparatus according to claim 10, wherein the print medium is long web paper.

14. The printing apparatus according to claim 1, wherein the recording elements are of an inkjet type discharging ink droplets.

15. The printing apparatus according to claim 14, wherein the print medium is long web paper.

16. The printing apparatus according to claim 1, wherein the print medium is long web paper.

17. A detecting method of detecting deformation of a print medium by a printing apparatus having a printing unit with a plurality of recording elements arranged in a width direction of the print medium, the method comprising:

a printing step of printing a correcting chart for correcting recording densities of the recording elements individually to the print medium;

a density information obtaining step of obtaining density information on the correcting chart printed to the print medium;

a moving average-value calculating step of setting at least two different numbers of successive recording elements among the recording elements as moving average widths in accordance with the density information on the correcting chart, and calculating moving average values of the density information of the recording elements for the moving average widths;

a standard deviation calculating step of calculating a standard deviation using one of the moving average values for a first small moving average width of the moving average widths as actual measurement data and using another one of the moving average values for a second large moving average width of the moving average widths as an average value of the actual measurement data; and a determining step of determining that the deformation occurs in the print medium when the standard deviation as a determination value exceeds a threshold.

18. The detecting method of detecting the deformation of the print medium according to claim 17, further comprising:

prior to the determining step, a density average-value calculating step of calculating a density average value for the moving average value for the small moving average width; and a variation rate calculating step of calculating a variation rate of the standard deviation relative to the density average value, and wherein the rate is used as the determination value in the determining step.

19. The detecting method of detecting the deformation of the print medium according to claim 18, wherein the recording elements are of an inkjet type discharging ink droplets.

20. The detecting method of detecting the deformation of the print medium according to claim 17, wherein the recording elements are of an inkjet type discharging ink droplets.

* * * * *